US006023895A

United States Patent [19]

Anderson

[11] Patent Number: 6,023,895

[45] **Date of Patent: *Feb. 15, 2000**

[54] LOG INTERFACE AND LOG WALLS AND BUILDINGS CONSTRUCTED THEREFROM

[76] Inventor: Theodore W. Anderson, 6011 Miller Rd., Ringwood, Ill. 60072

[ * ] Notice: This patent issued on a continued prosecution application filed under 37 CFR 1.53(d), and is subject to the twenty year patent term provisions of 35 U.S.C. 154(a)(2).

[21] Appl. No.: 08/881,703

[22] Filed: Jun. 24, 1997

[51] Int. Cl.[7] ..... E04B 1/10

[52] U.S. Cl. ..... 52/233; 52/592.5

[58] Field of Search ..... 52/233, 285.4, 52/286, 592.5, 592.6

[56] References Cited

U.S. PATENT DOCUMENTS

| | | | |
|---|---|---|---|
| 2,005,921 | 6/1935 | Reither | 52/233 |
| 2,040,110 | 5/1936 | Tahvonen et al. | 52/233 |
| 2,525,659 | 10/1950 | Edson et al. | 52/233 |
| 3,440,784 | 4/1969 | Onjukka | 52/233 |
| 4,034,527 | 7/1977 | Jalasjaa | 52/233 |
| 4,147,000 | 4/1979 | Lewandowski | 52/233 |
| 4,649,683 | 3/1987 | Dolata | 52/233 |
| 4,742,657 | 5/1988 | Veech | 52/233 |
| 4,823,528 | 4/1989 | Faw | 52/233 |
| 4,951,435 | 8/1990 | Beckedorf | 52/233 |

FOREIGN PATENT DOCUMENTS

| | | | |
|---|---|---|---|
| 476660 | 9/1951 | Canada | 52/233 |
| 1373787 | 8/1964 | France | 52/233 |

OTHER PUBLICATIONS

Book: Complete Guide to Building Log Homes by Monte Burch, Sterling Publishing Co., Inc., New York, NY 1990, attached are Title Page and reverse side thereof, Contents and pp. 141–143, 149–153, 215, 261, 378–379.

*Primary Examiner*—Michael Safavi
*Attorney, Agent, or Firm*—Leydig, Voit & Mayer, Ltd.

[57] ABSTRACT

A log wall and log building construction utilizing an improved log having a base with a central chordal surface that runs longitudinally along the log and a channel extending into the log on each side of the chordal base surface. The channels define an outwardly extending channel wall cooperating with the surface of the log and defining an edge that will form a seal with the subjacent log having a cooperating configuration. The surface opposite the base of the logs described above has a chordal longitudinal recess with a longitudinal parallel bead on each side of the recess. Each bead is designed to cooperate with the corresponding channel of an overlying log to form an enhanced seal along the line of engagement between the edge of the log base and the surface of the subjacent log outwardly of the respective bead.

17 Claims, 4 Drawing Sheets

LOG INTERFACE AND LOG WALLS AND BUILDINGS CONSTRUCTED THEREFROM

This invention relates to a log intended for building construction and having an improved log interface and to log walls and buildings constructed therefrom.

BACKGROUND OF THE INVENTION

1. Field of the Invention

The construction of homes and other buildings from logs is an ancient art. In recent years the desire for log buildings, and especially log homes, has increased tremendously, especially in North America. Much of the increased interest in log home construction and ownership has resulted from the use of more modern fabricating and constructing techniques which provide a building with enhanced appearance, thermal characteristics, structural integrity, reduced maintenance and other factors which are expected by the home owner today.

2. The Log Building Art

In the earlier days of log building construction, round logs were employed usually notched near the corners to provide some structural integrity to the overall construction but leaving much to be desired with respect to ease of fabrication, thermal integrity, the level of maintenance and the like. In general, such round log building construction has required very substantial chinking between the round logs to provide a continuous wall and a reasonable level of thermal and structural integrity. Such walls are often referred to as "chinked walls".

Historically, such log buildings have also been constructed with logs that had flattened sides and square notches to bring the flat sides of the logs closer together, reduce the amount of chinking required, enhance thermal characteristics and reduce maintenance. However, the accelerated interest in log buildings and in particular log homes, resulted from constructions which can generally be described as "chinkless". One early form of chinkless construction involved a scribing of one log of a wall to approximately match the contour of the log below it. This scribed log construction brought the logs together. When the logs were milled or otherwise shaped to fit together more intimately, minimum chinking or only caulking could be employed. As interest developed, especially in North America, various configurations developed which were structurally more secure and thermally better isolated. Such interfaces have included flattened top and bottom surfaces of the logs for broader and more intimate contact therebetween, as well as one or more tongues in one of the log faces to cooperate with and intermesh with corresponding grooves in the relatively flat face of an adjacent log. Many of these tongue and groove configurations are known in the art, but all have shortcomings with respect to ease of manufacture, intimacy of the log to log fit, thermal characteristics, tolerance for the dimensional instability of wood, the level of required maintenance, and the like.

SUMMARY OF THE INVENTION

Objects

In view of the foregoing, it is one object of this invention to provide an improved interface between two adjacent logs of a log wall.

A more specific object is to provide such an interface having enhanced thermal, structural and manufacturing advantages and walls and buildings produced therefrom.

It is another object of this invention to provide such an interface in a building wall construction or in an entire building taking full advantage of some generally known fabricating and assembly techniques which have a synergism with the unique interface of this invention.

Summary

The interface of this invention provides a modified log construction having a base with a central chordal surface that runs longitudinally along the log and a channel extending into the log on each side of the chordal base surface. The channels define an outwardly extending channel wall cooperating with the surface of the log and defining an edge that will form a seal with the subjacent log having a cooperating configuration. The surface opposite the base of the logs described above has a chordal longitudinal recess with a longitudinal parallel bead on each side of the recess. Each bead is designed to cooperate with the corresponding channel of an overlying log to form an enhanced seal along the line of engagement between the edge of the log base and the surface of the subjacent log outwardly of the respective bead.

BRIEF DESCRIPTION OF THE DRAWINGS

For a more complete understanding of the invention, reference will now be made to the drawings, wherein.

DESCRIPTION OF THE PREFERRED EMBODIMENTS

Figure 1:
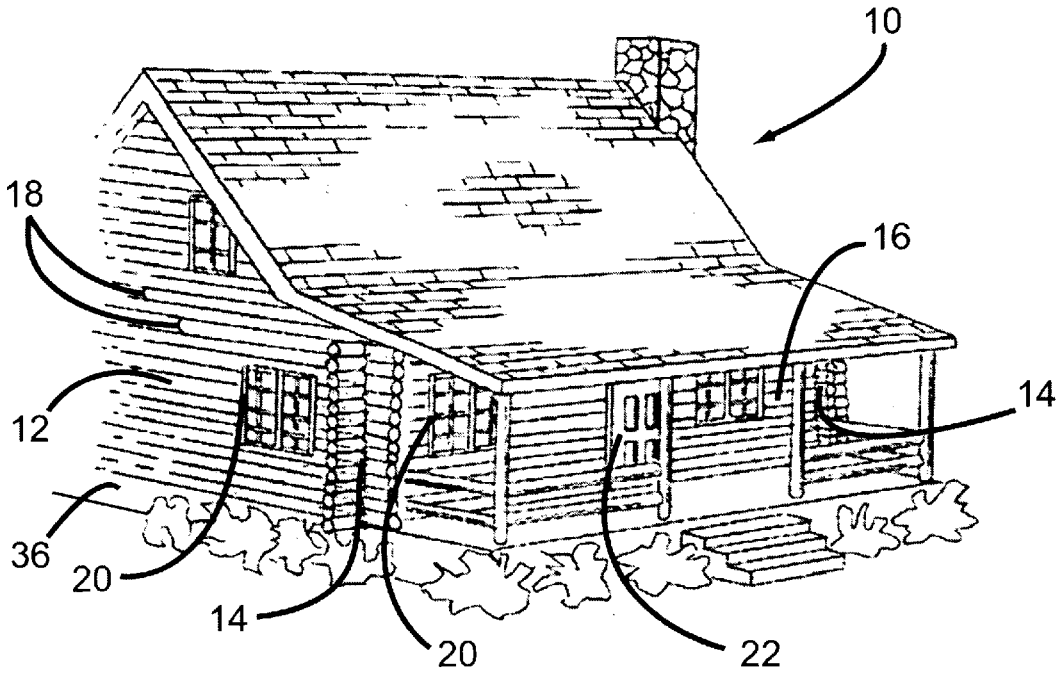
FIG. 1 is a diagrammatic illustration of a log home incorporating the logs, log interfaces and log walls of this invention.

Referring now to the drawings and more particularly to FIG. 1, a log home 10 is schematically illustrated including a side or "short" wall 12 comprising overlying full logs which rest on foundation 36 and intersect at corner 14 with a long wall 16 also formed of overlying full logs.

Logs for construction of log homes come in many varieties from many types of trees and in many lengths. Typical of the construction of a log home such as home 10 which uses full logs is the use of eastern white pine obtained in Massachusetts and in the northeastern forests. Many manufacturers fabricate kits of logs which are pre-cut and pre-shaped and modified for specific interconnection in an overall assembly scheme. The logs are frequently coded at the factory to make on-site assembly simpler, fast and more efficient.

One specific embodiment described in greater detail herein is made up of logs having a nominal 10 inch diameter and varying in length up to approximately 20 feet. The diameter of the logs, the length of the logs and the mode of fabrication and assembly into a building are matters of choice over a wide range and generally depend upon customer choice. Where the length of a side of the building exceeds the selected maximum length for logs such as 20 feet, butt joints 18 appear in the wall as diagrammatically indicated in FIG. 1. Some type of stabilization such as splines or mortising may be used with this invention to enhance the quality of butt joints. At the option of the fabricator, openings in the walls 12 and 16 for fenestration can be included at the time of original erection of the wall. Conversely, a solid wall is often constructed and fenestration openings cut into the wall thereafter. In either event, windows such as windows 20 and doors such as door 22 are fitted into the log walls in a manner that allows for the inherent dimensional adjustments as the structure ages and is exposed to environmental conditions. The construction of this invention is especially suited for such installations.

Historically, the earliest log buildings were completely hand fabricated with the walls notched at the corners and adjacent logs in a given wall of a building being simply stripped of bark and perhaps some sap wood and assembled with spaces of varying width between adjacent logs. These spaces were then stuffed with whatever the fabricator had available, sometimes old cloth or insulation followed by a chinking material. In some cases the material hardened and cracked but in others remains plastic. Such log constructions were subject to high maintenance and deterioration from exposure to severe environmental conditions. A log wall inherently has a very high thermal insulation when the joint between adjacent walls is constructed to minimize the problems from the chinked style. Such benefits and others are attained using this invention.

Figure 2:
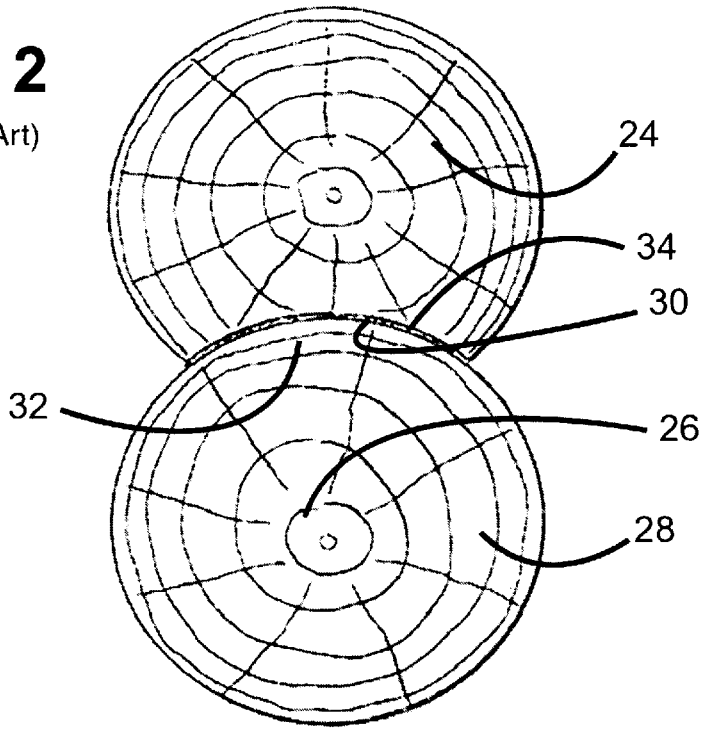
Fig. 2 (Prior Art)
FIG. 2 illustrates the prior art, a scribed log chinkless construction and interface.

FIG. 2 illustrates an early improvement over the chinked wall construction described above and illustrates what is often characterized as "chinkless". It comprises a scribed configuration of two adjacent logs of the wall. The upper log 24 has been scribed with a compass effectively pivoted around a point near the center 26 of the lower or subjacent log 28. The scribe line 30 is then used for cutting a longitudinal segment out of the overlying log 24 to accommodate the upper arcuate segment 32 of the subjacent log 28. Insulation 34 is often placed between the two logs to enhance the thermal characteristics of the joint. However, because of the vicissitudes in dealing with wood and particularly logs, the seal between the two arcuate faces of logs 24 and 28 is often inefficient.

The scribed joint of FIG. 2 was one of the early chinkless styles which became very popular in the Northern U.S. However, because of the performance limitations of the scribed joint as set forth above, various modifications have developed over the years. For example, while the hand-stripped and tapered log of earlier days provided reasonably stable structures, the development of modern sawing and milling techniques led to the use of milled logs including milled faces for the intersection of adjacent logs and other mass-production techniques. Round log walls and scribed round log walls as shown in FIG. 2 have been strengthened and enhanced by the addition of longitudinal grooves in the two adjacent surfaces and one or more splines laid in the grooves to stabilize the wall and provide enhanced structural integrity. This history and additional enhancements are described in the book *Complete Guide to Building Log Homes* by Monte Borch, Sterling Publishing Co, Inc., 1990 (i.e., 147 ed. seq.).

Further enhancement, cost reduction and quality control has been attained by milling. Logs are often fabricated by sawing a large tree into square logs having a dimension approximately equal to the desired ultimate diameter. Preferably, such square logs are taken at the heart of the tree for optimum strength and stability and peripheral sap wood is to be avoided. Such a milled log can be left flat or milled flat on two, three or four sides. However, the embodiment described was milled to a square cross section and then further milled to produce the shapes shown and described in FIGS. 4 and 5. Where prior log configurations had two milled surfaces that abut, one or more splines can be employed in grooves in the adjacent surfaces. Also known heretofore was the formation of one or more tongues and grooves which tend to cooperate to stabilize the wall structure and enhance thermal characteristics and the like.

Figure 3:
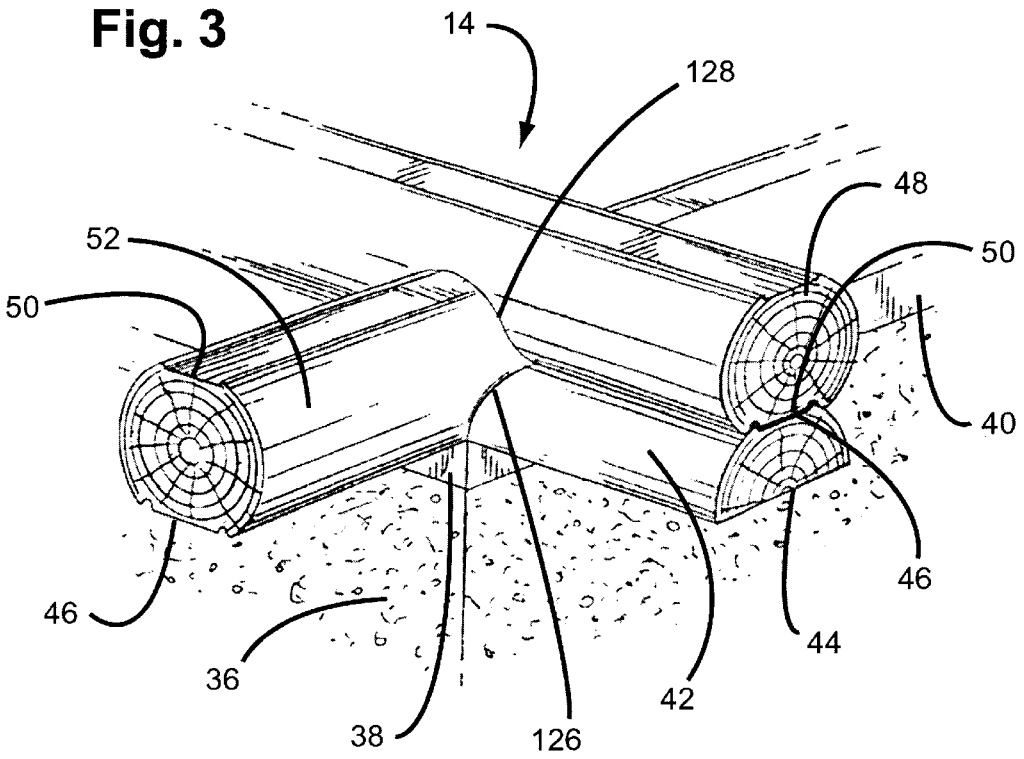
FIG. 3 illustrates the interface of this invention applied to the corner of a log building.

The interface between adjacent logs of a wall made according to this invention differs from all of the foregoing prior configurations in several important respects. Referring to FIG. 3, an enlarged portion of the bottom of a corner 14 as shown in FIG. 1 is illustrated. A foundation 36 of appropriate aggregate is illustrated with a short wall sill plate 38 and a long wall sill plate 40 shown diagrammatically. A sill log 42 is shown resting on the short wall sill plate 38. While the sill log 42 is shown as having a flat diametric base, the particular shape of the bottom 44 can be milled to match whatever shape or characteristics are provided in the sill plate 38. The upper portion 46 of sill log 42 has an interface constructed in accordance with this invention and the overlying log 48 of the short wall has the base interface of this invention which cooperates with the upper or recessed interface 46 of sill log 42. Each log above the log 48 will have the log milled to a generally round configuration with the base and cap configured as shown in log 48.

A log 52 of the long wall 16 intersects the logs 42 and 48 of the short wall in the manner shown and in a manner to be described in greater detail below. The log 52 like the logs 42 and 48 has the base interface 46 and a recess interface 50 as used on the logs throughout this described embodiment of the invention. The particular log configuration and interface dimensions are illustrated in FIG. 4 and 5.

Figure 4:
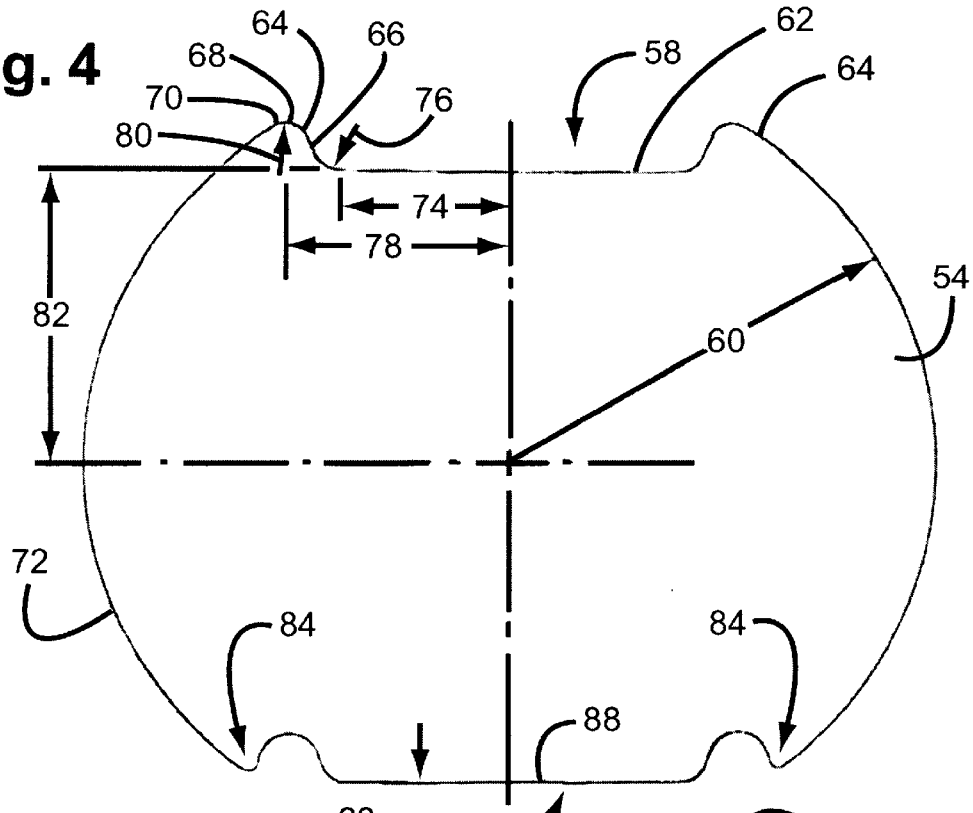
FIG. 4 illustrates the cross section of a log constructed in accordance with this invention with details of the cap having a recess in accordance with this invention.
Figure 5:
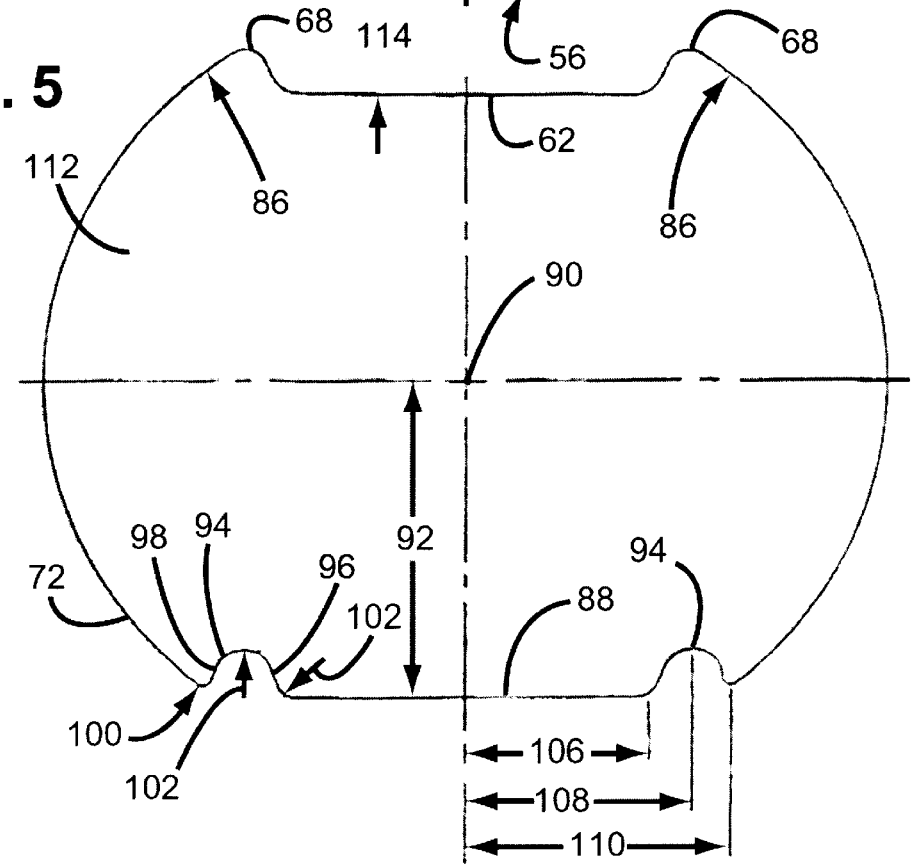
FIG. 5 is an illustration of the log cross section in accordance with this invention with details of the base of the interface of this invention.

Referring specifically to FIG. 4, a cross section of the log, as milled, is shown with the details of the cap described and referenced in greater detail. The log contour 54 of FIGS. 4 and 5 is the same and is a contour of a log, as milled. From the very nature of wood, the dimensions will change somewhat but it has been found that the functional relationships between the base configuration 56 and the cap configuration 58 remain sufficiently stable to provide the structural relationships and functions described herein.

The tool designed to form the cylindrical log surface 72 and the cap 58 mills a nominal 10×10 inch square log. As a result of that process, the radius 60 is 4.75 inches for an actual log diameter of 9.5 inches. The cap 58 is milled into the log 54 using the tool which forms the chordal recess 62 with an outwardly extending bead 64 parallel to and on each side of the recess 62. Each bead is formed with an inner wall 66, a bight portion 68 and an outer wall 70. The latter blends with the log surface 72.

The location 74 of the center for the radius 76 and the radius are listed in a table which follows. Similarly, the location of the center 78 and the radius 80 for the bead bight and outer wall are listed as is the distance 82 from the center of the log to the chordal recess 62. All of the listed dimensions are for a nominal 10 inch log with the milled log surface radius of 4.75 inches. The log interface of FIG. 4 has been displaced above the log interface of FIG. 5 for clarity. It should be understood that the two logs represented by FIGS. 4 and 5 would be in physical engagement with the intended contact point 84 on the base 56 of log 54 aligning with the design contact point 86 on the surface of the lower log 112 adjacent the bead 68.

Referring to FIG. 5, the corresponding dimensions for the base interface 56 are as follows. The base 56 has a chordal base portion 88 spaced from the center 90 by the distance 92. Again for the nominal 10 inch log the dimensions of the base interface 56 are set forth in the table below. On each side of the chordal central base section 88 is a channel 94 configured to receive the beads 64. Each channel comprises an inner channel wall 96 and an outer channel wall 98. The outer channel wall 98 forms a tapered edge with the log surface 72 defined by the small radius 100. The radius 100 is appropriately located to produce a curve tangent with the log surface 72 and having a line of inflection with respect to the channel portion defined by radius 102. Similarly, the junction of the central portion of the channel with the chordal base portion 88 is defined by the radius 104. The location of the centers for the radius 104, 102 and 100, respectively, are indicated by the distances 106, 108 and 110. These dimensions of the base are also set forth in the table below which include the dimensions of the cap 58.

TABLE OF DIMENSIONS

Nominal 10" Eastern White Pine Log
(in inches)

| | |
|---|---|
| 60 Log Radius | 4.7500 |
| 74 Center-Recess Chord to Bead Radius | 1.9218 |
| 76 Radius-Recess Chord to Bead | 0.3125 |
| 78 Center-Bead Bight Radius | 2.5207 |
| 80 Radius-Bead Bight | 0.2500 |
| 82 Recess Chord Offset | 3.4114 |
| 92 Base Chord Offset | 3.8176 |
| 100 Edge Radius | 0.0787 |
| 102 Radius-Channel | 0.3375 |
| 104 Radius-Channel to Base Chord | 0.2500 |
| 106 Center-Channel to Base Chord Radius | 2.0637 |
| 108 Center-Channel Radius | 2.5541 |
| 110 Center-Edge Radius | 2.9873 |
| 114 Spacing-Chordal Base to Chordal Recess | 0.1546 |

As mentioned above, the log of FIG. 4 is displaced above the log of FIG. 5, but in fact would rest through contact lines 84 and 86 on the lower log 112. When so located, the dimension 114 is reduced to a space defined by the separation of base 88 from recess 62, that spacing being 0.1546 inch.

In the preferred design a web of fiberglass insulation 0.5 inch thick and having an appropriate width to fit between the beads 68 is placed between the logs at the time the upper log 72 is set in place. While a caulk can be applied if desired, it appears that the interface between the edges 84 and the surface 72 of the subtending log at the point of contact 86 is such that an effective seal is formed mitigating any need for a caulk or chink. Experience has indicated that when an upper log 72 is raised or removed, the contact lines 86 in the lower log have been compressed by the weight of the upper log to provide a distinct channel and increased contact area along the lines 68.

Figure 6:
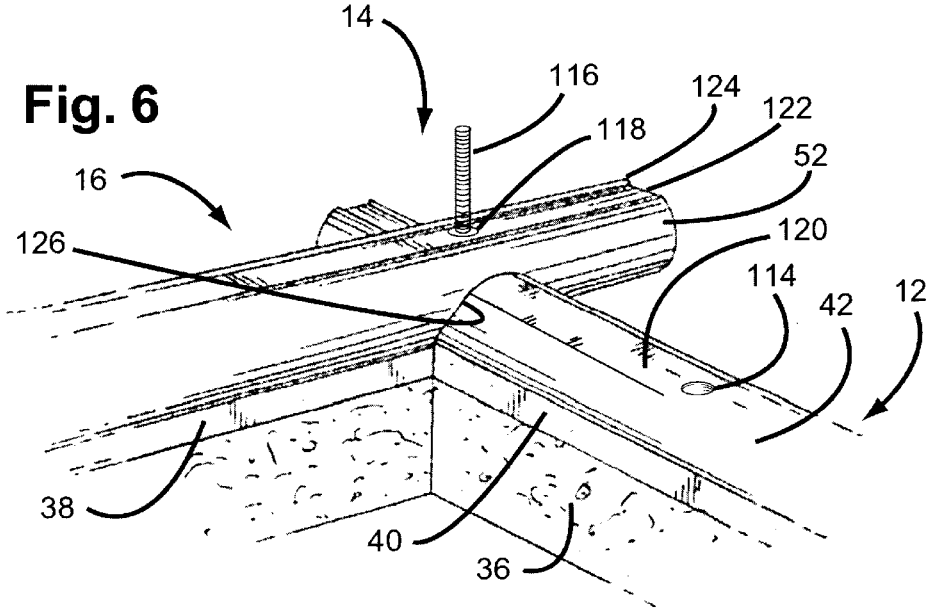
FIG. 6 is another view of the corner showing the intersection of a sill log and a first transverse log each resting on a sill plate and a foundation.

Referring now to FIG. 6, the configuration of the corner 14 of the long wall and the short wall is illustrated in somewhat greater detail.

As already described with respect to FIG. 3, for diagrammatic purposes FIG. 6 shows an aggregate foundation 36 with a wooden sill plate 38 secured thereto for supporting the longer wall 16 and sill plate 40 for supporting the short wall 12. In the preferred construction anchor bolts are cast into the aggregate foundation 36 and extend upwardly to secure the sill plates 38 and 40 and the sill log 42 of the short wall and the first log 52 of the long wall. The anchor bolts are not shown in FIG. 6 although the aperture 114 for one anchor bolt is diagramatically shown. Furthermore, an anchor bolt may be disposed at the intersection of the long wall and short wall in order to facilitate assembly of the building walls. With respect to the corner anchor bolt, it is preferred that a threaded coupling be placed on the anchor bolt and lengths of threaded rod such as rod 116 be secured to the anchor bolt and extended with successive couplings and rods to the full height of the wall. The threaded rod 116 is shown extending through an appropriate apperture 118 in the log 52 constructed in accordance with this invention.

As shown in FIG. 6, the cap recess 120 on the sill log is visible with the anchor bolt aperture 114 disposed therein. Similarly, the cap recess 122 and beads 124 of log 52 are visible. The intersection of the two walls is facilitated by a transverse saddle notch formed in the bottom or base of log 52 to accommodate the cross section of the sill log 42. The second log 48 as shown in FIG. 3 has a similar saddle notch 128 formed in the short wall log 48 to accommodate the long wall log 52. As is clear from a comparison of FIG. 6 and FIG. 3, the log 52 leaves a gap adjacent the chordal recess 120. However, placing of the second log 48 for the short wall 12 encloses that space and provides substantial structural and environmental integrity. As already mentioned, it has been found that in general the edges 84 form a sufficient seal against the log surface at 86 (see FIGS. 4 and 5) so that no caulking is necessary. However, because of the complexity of the interface of the two walls at the corner 14, it is preferred that the arcuate interfaces between intersecting logs be caulked with an appropriate caulking material. A caulking material that has been found to be satisfactory for this purpose is Puttylastic sold by Continental Products, Inc. of Euclid, Ohio. Any appropriate caulk can be employed, but preferably a caulk that remains pliable over a long period of time.

Figure 8:
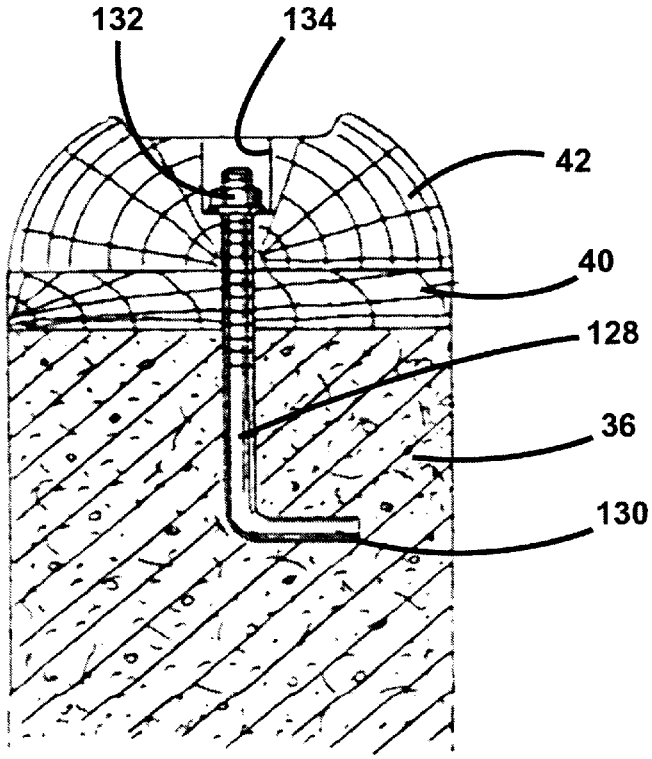

One particular mode of anchor bolt configuration is shown in FIG. 8. In FIG. 8 the aggregate foundation 36 is shown supporting the sill plate 40 which in turn has the sill log 42 supported thereon. The anchor bolt 128 is shown extending into the aggregate foundation 36 with an L portion 130 for more secure engagement of the anchor in the aggregate.

The sill log 42 is apertured to match the position of the anchor bolt as it extends through the sill plate 40. The sill log 42 has a countersink 134 to accommodate a nut 132 for securing the sill log against the sill plate 40 and in turn against the foundation 36.

If the anchor bolt is a corner anchor bolt than the nut 132 is replaced with a coupler (not shown) to receive a threaded extension rod such as the rod 116 in FIG. 6. Depending upon the particular application, a washer and nut can be threaded against each log as the corner is built or the rods 116 can extend through appropriate couplings to the top of the wall to assist in aligning the logs and supporting them in the appropriate stacked relationship during erection.

Figure 7:
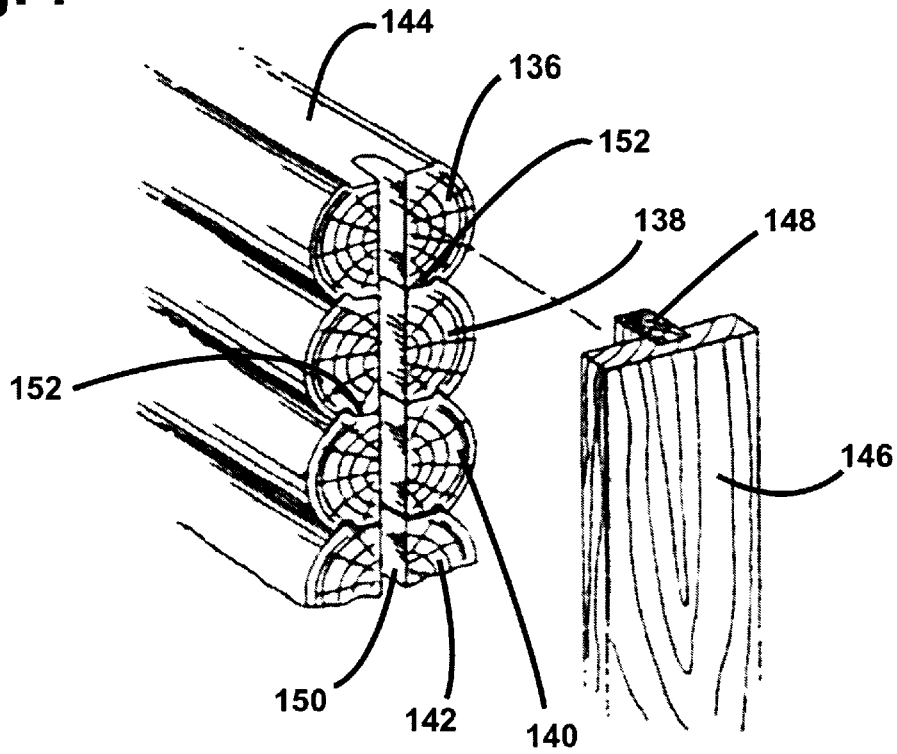
FIG. 7 illustrates a fragment of one wall and specifically an internal edge of a wall according to this invention to accommodate fenestration; and, FIG. 8 is an enlarged illustration of the anchor system of this invention.

Referring to FIG. 7, the logs 136–142 are constructed and arranged in accordance with this invention. However, the particular portion illustrated in FIG. 7 corresponds to the portion of the log wall adjacent the fenestration openings such as openings 20 and 22 for doors and walls, respectively, in FIG. 1.

Log homes inherently settle, shrink and to some extent distort from atmospheric conditions, aging, and the like. Thus, window frames, internal walls, etc. are provided with channels and grooves to accommodate relative slipping motion between the window framing or buck and the log wall. In FIG. 7 a splined slip joint is provided between the wall 144 and the framing 146. The slip joint comprises a spline 148 which slides in a groove 150. The log design of this invention accommodates such arrangements efficiently and in general the spline and channel do not interfere with the interface of the logs or the efficient operation of the interface.

In general, it may be appropriate to provide insulation on the spline or against the framing or buck 146. Caulk can be put in the space 152 of the interface between the chordal recess in the log 140 for example and the chordal base 154 in the overlying log 138. To accommodate this caulk for appearance and insulation purposes, the fiberglass insulation extending along the length of the log interface terminates just short of the ends of the logs 136–142 to accommodate the caulk. Similarly, referring to FIG. 3, for example, a preferred installation includes 0.5 inch of fiberglass insulation in the space 152. However, in the preferred embodiment that insulation terminates short of the ends of the logs and the ends of the logs may be preferably sealed with a caulking material such as Puttylastic.

A preferred embodiment has been described in substantial detail and specifically a configuration for a log wall and building having logs with an optimum 10 inch diameter. However, the invention can readily be applied with the teaching herein to logs of a wide range of diameters and lengths fabricated from a wide variety of wood types. The invention is limited only by the following claims.

What is claimed:

1. A building having walls that include a plurality of generally horizontal cylindrical logs with upper, lower and side surfaces, said lower and upper surfaces having modified base and cap portions, respectively, to form an interface between adjacent logs, each of said interfaces comprising: a first modified log with a longitudinally extending base formed in the lower surface thereof, said base having a cross section including a major generally flat central base portion and a relatively narrow adjacent channel portion extending from said central base portion to each of said side surfaces, each channel portion including an inner channel wall forming an obtuse angle with said central base portion and an outer channel wall, said outer channel wall extending outwardly to the surface of said log and forming an acute angle and a tapered edge therewith; and, a second modified log disposed beneath said first log and generally parallel thereto, said second log having a longitudinally extending cap formed in the upper surface thereof, said cap having a cross section including a major generally flat central recess portion and a relatively narrow bead portion extending respectively from said central recess portion to each of said side surfaces, each bead portion having a bight formed with an outer bead wall extending outwardly to the surface of said second log, said bead portions being received in the respective channel portions of said first log.

2. The building of claim 1 wherein a wall thereof includes a sill log having a sill face on said lower side configured to rest on an underlying building substructure and having said cap on the upper surface thereof to receive the base of an overlying log.

3. A building including a first wall and an angularly disposed second wall forming an intersection, each wall constructed according to claim 1, wherein the first wall includes a sill log having a sill face on said lower side configured to rest on an underlying building substructure and having said cap on the upper surface thereof to receive the base of an overlying log of said first wall, the logs of each wall having a cut-out in said lower surface to accommodate the subjacent log of the other wall.

4. The building of claim 3 wherein the cut-outs of the first wall and the second wall are scribed cut-outs having an axis aligned with the longitudinal axis of the logs of the second wall and the first wall respectively and conforming to the surfaces of the underlying log.

5. A building including a first wall and a second wall, each according to claim 1, said walls intersecting to form a corner wherein a first log of said first wall has a scribed cut-out portion in the lower surface spaced from the end of said first log and overlying a subjacent log of said second wall, said cut-out portion resting on said subjacent log at a position spaced from the end of said subjacent log.

6. The building of claim 3 wherein said walls have aligned vertical apertures therein at said intersection, have a threaded anchor secured in said underlying substructure and extending into said aligned apertures, and have a threaded fastener attached to said threaded anchor to stabilize said wall.

7. The building according to claim 5, wherein the surfaces of said first log and said subjacent log are caulked where the surface of said first log engages the surface of said subjacent log.

8. A log interface for log wall constructions that include a plurality of generally horizontal cylindrical logs with upper, lower and side surfaces, said interface comprising a first modified log with a longitudinally extending base formed in the lower surface thereof, said base having a cross section including a major generally flat central base portion and a relatively narrow adjacent channel portion extending respectively from each side of said central base portion to each of said side surfaces, each channel portion including an inner channel wall forming an obtuse angle with said central base portion and an outer channel wall, said outer channel wall extending outwardly to the surface of said log and forming an acute angle and a tapered edge therewith.

9. The log interface of claim 8 including a second modified log disposed beneath said first log and generally parallel thereto, said second log having a longitudinally extending cap formed in the upper surface thereof, said cap having a cross section including a major generally flat central recess portion and a relatively narrow bead portion extending respectively from said central recess portion to each of said side surfaces, each bead portion having a bight formed with an outer bead wall extending outwardly to the surface of said second log, said bead portions being received in the respective channel portions of said first log.

10. The log interface for generally vertically extending log wall constructions according to claim 8 wherein said modified log has a longitudinally extending cap formed in the upper surface thereof, said cap having a cross section including a major generally flat central recess portion and a relatively narrow bead portion extending respectively from said central recess portion to each of said side surfaces, each bead portion being formed with a bight and an outer bead wall extending from said bight to join the surface of said log.

11. The log interface of claim 9 wherein said central base portion is spaced from said central recess portion.

12. The log interface of claim 11 including insulation occupying the space between said central portions.

13. The log interface of claim 12 wherein said insulation is a compressible web and the thickness of said web is substantially greater than the space between said central portions.

14. The log interface of claim 9 wherein the optimum dimensions of said channel portions provide engagement with said bead portions and the space between said generally flat central portions is substantially sealed.

15. The log interface of claim 9 including a sealant disposed between said cap and said base adjacent the ends of said logs.

16. The log interface of claim 13 wherein said insulation is a fiberglass web having an uncompressed thickness approximately three times the spacing between said central base portion and said central recess portion.

17. The log interface of claim 8 wherein the modified log has a longitudinally extending cap formed in the upper surface thereof which has a major flat central recess portion spaced from the central base portion thereof for receiving the central base portion of an adjacent one of said plurality of logs having said base formed in the lower surface thereof.

* * * * *